US010032575B2

(12) United States Patent
Chen

(10) Patent No.: US 10,032,575 B2
(45) Date of Patent: Jul. 24, 2018

(54) KEYBOARD DEVICE

(71) Applicant: Primax Electronics Ltd., Taipei (TW)

(72) Inventor: Tsu-Yi Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/367,732

(22) Filed: Dec. 2, 2016

(65) Prior Publication Data

US 2018/0040438 A1 Feb. 8, 2018

(30) Foreign Application Priority Data

Aug. 5, 2016 (TW) ..... 105124971 A

(51) Int. Cl.

| | |
|---|---|
| ***H01H 1/10*** | (2006.01) |
| ***H01H 13/704*** | (2006.01) |
| ***H01H 13/14*** | (2006.01) |
| ***H01H 13/7065*** | (2006.01) |
| ***H01H 13/703*** | (2006.01) |

(52) U.S. Cl.

CPC ..... *H01H 13/704* (2013.01); *H01H 13/14* (2013.01); *H01H 13/703* (2013.01); *H01H 13/7065* (2013.01)

(58) Field of Classification Search

CPC ..... H01H 13/00; H01H 13/10; H01H 13/12; H01H 13/02; H01H 13/14; H01H 13/20; H01H 13/26; H01H 13/50; H01H 13/70; H01H 13/702; H01H 13/703; H01H 13/705; H01H 13/704; H01H 13/83; H01H 13/7065; H01H 2003/00; H01H 2009/16; H01H 2009/161; H01H 2009/182; H01H 2009/183; H01H 2009/184; H01H 2009/0278; H01H 2201/00; H01H 2211/00; H01H 2209/046; H01H 2209/068; H01H 2209/074; H01H 2209/016; H01H 2215/008; H01H 2221/002; H01H 2221/004; H01H 2221/062; H01H 2223/003; H01H 3/00; H01H 3/02; H01H 3/12; H01H 3/25; H01H 71/025; H01H 71/1018; H01H 71/24; H01H 2003/02; H01H 2003/12; G06F 3/02

USPC ..... 200/5 R, 5 A, 46, 406, 511–514, 200/520–521, 308, 310–314, 317, 337, 200/341–345, 510, 269, 292, 329

See application file for complete search history.

(56) References Cited

U.S. PATENT DOCUMENTS

2010/0259423 A1* 10/2010 Randall ..... H01H 13/70 341/24

2015/0338883 A1* 11/2015 Farahani ..... G06F 1/1656 361/679.1

* cited by examiner

*Primary Examiner* — Anthony R. Jimenez

(74) *Attorney, Agent, or Firm* — Muncy, Geissler, Olds & Lowe, P.C.

(57) ABSTRACT

A keyboard device includes a base plate, a key and a membrane circuit board. The key is connected with the base plate. The membrane circuit board is arranged between the key and the base plate. The base plate includes a connecting structure. The connecting structure is protruded upwardly and penetrated through the membrane circuit board. The key includes a keycap and a stabilizer bar. The stabilizer bar is pivotally coupled to the keycap. A hook part of the stabilizer bar is penetrated through a corresponding locking hole of the connecting structure. A film layer of the membrane circuit board includes an extension part. A gel layer is formed on the extension part. While the keycap is moved upwardly or downwardly relative to the base plate, the hook part of the stabilizer bar is moved on the gel layer.

11 Claims, 12 Drawing Sheets

KEYBOARD DEVICE

FIELD OF THE INVENTION

The present invention relates to an input device, and more particularly to a keyboard device.

BACKGROUND OF THE INVENTION

Generally, the widely-used peripheral input device of a computer system includes for example a mouse device, a keyboard device, a trackball device, or the like. Via the keyboard device, characters or symbols can be inputted into the computer system directly. As a consequence, most users and most manufacturers of input devices pay much attention to the development of keyboard devices.

The structures and the functions of a conventional keyboard device 1 will be illustrated as follows. Please refer to FIGS. 1, 2 and 3. FIG. 1 is a schematic top view illustrating the outer appearance of a conventional keyboard device. FIG. 2 is a schematic exploded view illustrating a portion of the keyboard device of FIG. 1 and taken along a viewpoint. FIG. 3 is a schematic exploded view illustrating a portion of the keyboard device of FIG. 1 and taken along another viewpoint. For succinctness, only one key 10' and related components are shown in FIGS. 2 and 3.

The conventional keyboard device 1 comprises plural keys 10 and 10', a base plate 11 and a membrane circuit board 12. Each of the plural keys 10 and 10' comprises a keycap 101, a scissors-type connecting element 102 and an elastic element 103. The scissors-type connecting element 102 is connected between the keycap 101 and the base plate 11. Moreover, the scissors-type connecting element 102 comprises a first frame 1021 and a second frame 1022. The second frame 1022 is pivotally coupled to the first frame 1021. Consequently, the first frame 1021 and the second frame 1022 can be swung relative to each other. The elastic element 103 is arranged between the keycap 101 and the base plate 11. Moreover, the elastic element 103 comprises a contacting part 1031.

FIG. 4 is a schematic exploded view illustrating the membrane circuit board of the keyboard device as shown in FIG. 1. The membrane circuit board 12 comprises an upper film layer 122 and a lower film layer 123. A first circuit pattern 1221 is formed on a bottom surface of the upper film layer 122. The first circuit pattern 1221 comprises plural upper contacts 1222 corresponding to the plural keys 20 and 20'. A second circuit pattern 1231 is formed on a top surface of the lower film layer 123. The second circuit pattern 1231 comprises plural lower contacts 1232 corresponding to the plural upper contacts 1222. Each of the upper contacts 1222 and the corresponding lower contact 1232 are separated from each other by a spacing interval. Moreover, each of the upper contacts 1222 and the corresponding lower contact 1232 are collectively defined as a membrane switch 121. Moreover, for maintaining the spacing interval between each upper contact 1222 and the corresponding lower contact 1232, the membrane circuit board 12 further comprises an intermediate film layer 124. The intermediate film layer 124 is arranged between the upper film layer 122 and the lower film layer 123. In addition, the intermediate film layer 124 comprises plural perforations 1241 corresponding to the plural upper contacts 1222 and the plural lower contacts 1232.

While the keycap 101 of any key 10 or 10' is depressed and moved downwardly relative to the base plate 11, the first frame 1021 and the second frame 1022 of the scissors-type connecting element 102 are switched from an open-scissors state to a stacked state. Moreover, as the keycap 101 is moved downwardly to compress the elastic element 103, the corresponding membrane switch 121 is pushed and triggered by the contacting part 1031 of the elastic element 103. Consequently, the keyboard device 1 generates a corresponding key signal. When the keycap 101 of the key 10 or 10' is no longer depressed, the keycap 101 is moved upwardly relative to the base plate 11 in response to an elastic force of the elastic element 103. Meanwhile, the first frame 1021 and the second frame 1022 are switched from the stacked state to the open-scissors state again, and the keycap 101 is returned to its original position.

Please refer to FIGS. 1, 2 and 3 again. As shown in the drawings, the length L1 of the key 10' is larger than the width W1 of the key 10'. The key 10' further comprises a first stabilizer bar 104 and a second stabilizer bar 105. The first stabilizer bar 104 comprises a first transverse bar part 1041 and two first hook parts 1042. The two first hook parts 1042 are located at two ends of the first stabilizer bar 104, respectively. The second stabilizer bar 105 comprises a second transverse bar part 1051 and two second hook parts 1052. The two second hook parts 1052 are located at two ends of the second stabilizer bar 105, respectively.

The base plate 11 comprises a first connecting structure 111 and a second connecting structure 112. The first connecting structure 111 and the second connecting structure 112 are protruded upwardly, and penetrated through the membrane circuit board 12. The first connecting structure 111 comprises a first locking hole 1111 and a third locking hole 1112. The second connecting structure 112 comprises a second locking hole 1121 and a fourth locking hole 1122. The second locking hole 1121 corresponds to the first locking hole 1111, and the fourth locking hole 1122 corresponds to the third locking hole 1112.

The first transverse bar part 1041 of the first stabilizer bar 104 and the second transverse bar part 1051 of the second stabilizer bar 105 are pivotally coupled to the keycap 101 of the key 10'. The two first hook parts 1042 of the first stabilizer bar 104 are penetrated through the first locking hole 1111 of the first connecting structure 111 and the second locking hole 1121 of the second connecting structure 112, respectively. The two second hook parts 1052 of the second stabilizer bar 105 are penetrated through the third locking hole 1112 of the first connecting structure 111 and the fourth locking hole 1122 of the second connecting structure 112, respectively.

FIG. 5 schematically illustrates the actions of the first stabilizer bar and the second stabilizer bar of the keyboard device as shown in FIG. 1. While the keycap 101 of the key 10' is moved upwardly or downwardly relative to the base plate 11, the first stabilizer bar 104 is moved in the direction D11 or the direction D12 and rotated in the direction D13 or the direction D14. Similarly, the second stabilizer bar 105 is moved in the direction D11 or the direction D12 and rotated in the direction D13 or the direction D14. By this design, the key 10' is kept stable and not inclined while the key 10' is moved upwardly or downwardly relative to the base plate 11. Moreover, this design is helpful to increase the strength of the keycap 101.

However, the conventional keyboard device 1 still has some drawbacks. For example, all of the first stabilizer bar 104, the second stabilizer bar 105 and the base plate 11 are made of metallic material. Please refer to FIG. 5. While the keycap 101 of the key 10' is moved upwardly or downwardly relative to the base plate 11 and the first stabilizer bar 104 and the second stabilizer bar 105 are correspondingly moved and rotated, the two first hook parts 1042 of the first stabilizer bar 104 and the two second hook parts 1052 of the second stabilizer bar 105 are readily contacted with the metallic base plate 11. While the two first hook parts 1042 and the two second hook parts 1052 collide with the metallic base plate 11, a click sound is generated. This sound is unpleasant noise to the user.

For solving the above drawbacks, another conventional keyboard device was disclosed. FIG. 6 is a schematic perspective view illustrating a membrane circuit board of another conventional keyboard. FIG. 7 is a schematic cross-sectional view illustrating the membrane circuit board of FIG. 6 and taken along the line A-A. FIG. 8 schematically illustrates the actions of the first stabilizer bar and the second stabilizer bar of another conventional keyboard device. In comparison with the keyboard device of FIG. 1, the keyboard device as shown in FIGS. 6, 7 and 8 are distinguished by the following items. Firstly, the lower film layer 123' of the membrane circuit board 12' further comprises a first extension part 1233 and a second extension part 1234. The first extension part 1233 and the second extension part 1234 are extended toward the first connecting structure 111 and the second connecting structure (not shown). The two first hook parts 1042 of the first stabilizer bar 104 are separated from the base plate 11 by the first extension part 1233. The two second hook parts 1052 of the second stabilizer bar 105 are separated from the base plate 11 by the second extension part 1234. While the keycap 101 of the key 10' is moved upwardly or downwardly relative to the base plate 11 and the first stabilizer bar 104 and the second stabilizer bar 105 are correspondingly moved and rotated, the two first hook parts 1042 of the first stabilizer bar 104 and the two second hook parts 1052 of the second stabilizer bar 105 are respectively moved on the first extension part 1233 and the second extension part 1234. Since the two first hook parts 1042 and the two second hook parts 1052 are not directly contacted with the base plate 21, the two first hook parts 1042 and the two second hook parts 1052 do not collide with the base plate 11 to generate the unpleasant noise.

Nowadays, the trends of designing keyboard devices are designed toward small size, light weightiness and easy portability. Consequently, each film layer of the membrane circuit board becomes thinner and thinner. As mentioned above, the first extension part is extended from the lower film layer and arranged between the two first hook parts of the first stabilizer bar and the base plate, and the second extension part is extended from the lower film layer and arranged between the two second hook parts of the second stabilizer bar and the base plate. Under this circumstance, the efficacy of reducing the noise by the first extension part and the second extension part is largely reduced.

In other words, the conventional keyboard device needs to be further improved.

SUMMARY OF THE INVENTION

An object of the present invention provides a keyboard device. A gel layer is formed on an extension part of a membrane circuit board. Due to the gel layer, the distance between a hook part of a stabilizer bar and a base plate is increased. Even if the thickness of the membrane circuit board is reduced, the keyboard device also has the satisfied noise reducing efficacy.

In accordance with an aspect of the present invention, there is provided a keyboard device. The keyboard device includes a key, a base plate and a membrane circuit board. The key includes a keycap and a stabilizer bar. The stabilizer bar includes a transverse bar part and a first hook part. The transverse bar part is pivotally coupled to the keycap. The first hook part is located at a first end of the transverse bar part. The base plate is connected with the key, and includes a first connecting structure. The first connecting structure is protruded upwardly from the base plate and connected with the first hook part of the stabilizer bar. The membrane circuit board is arranged between the key and the base plate, and includes a membrane switch corresponding to the key. The membrane circuit board includes a first film layer and a second film layer. The first film layer and the second film layer are laminated together through a first gel layer. The second film layer includes a first extension part. The first extension part is extended toward the first connecting structure and exposed outside the first film layer. A second gel layer is formed on the first extension part. While the keycap is moved upwardly or downwardly relative to the base plate, the first hook part of the stabilizer bar is moved on the second gel layer.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
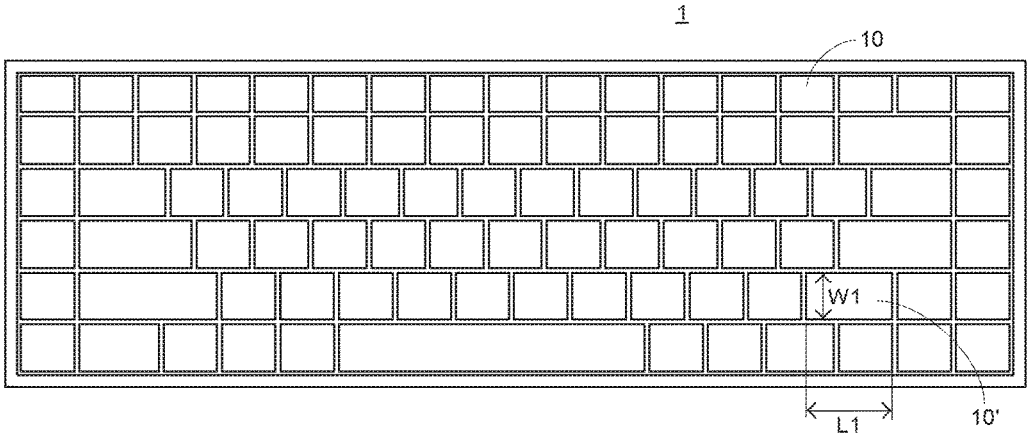
FIG.1 PRIOR ART
FIG. 1 is a schematic top view illustrating the outer appearance of a conventional keyboard device.
Figure 2:
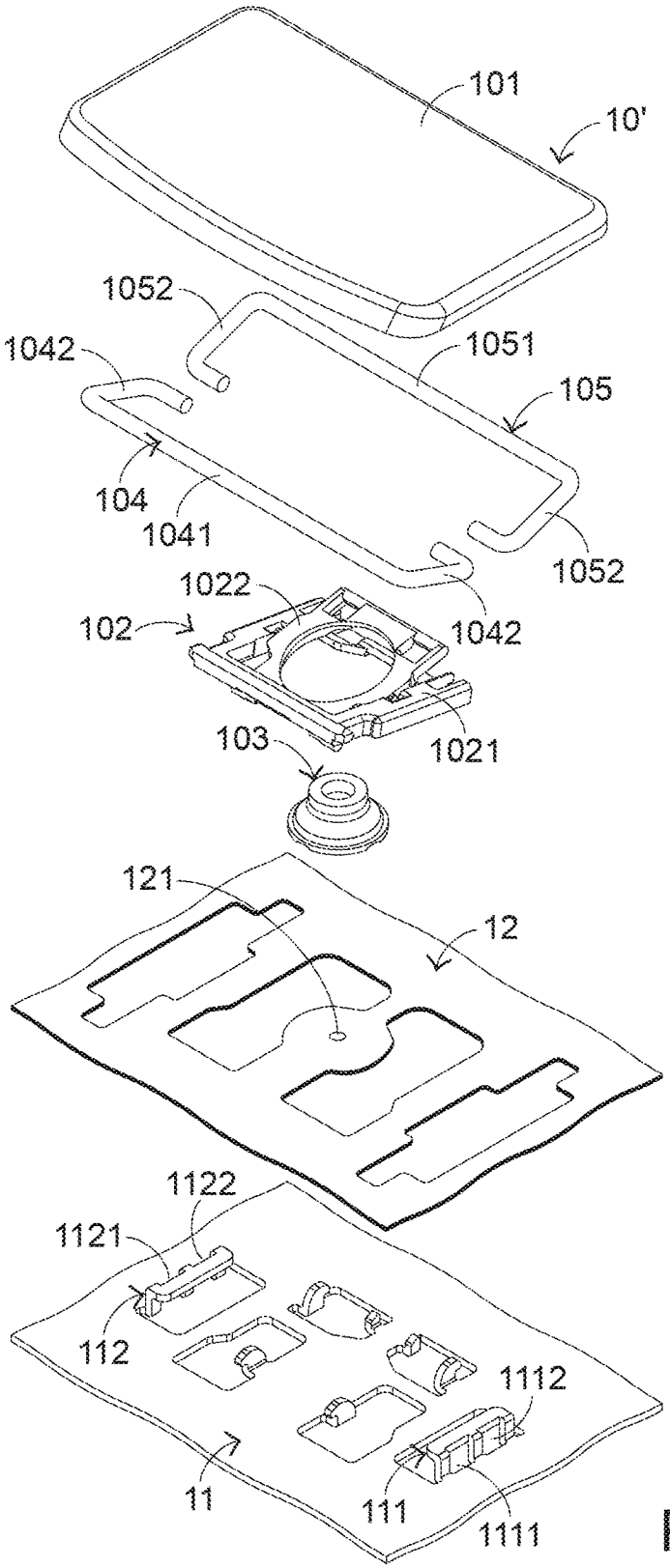
FIG.2 PRIOR ART
FIG. 2 is a schematic exploded view illustrating a portion of the keyboard device of FIG. 1 and taken along a viewpoint.
Figure 3:
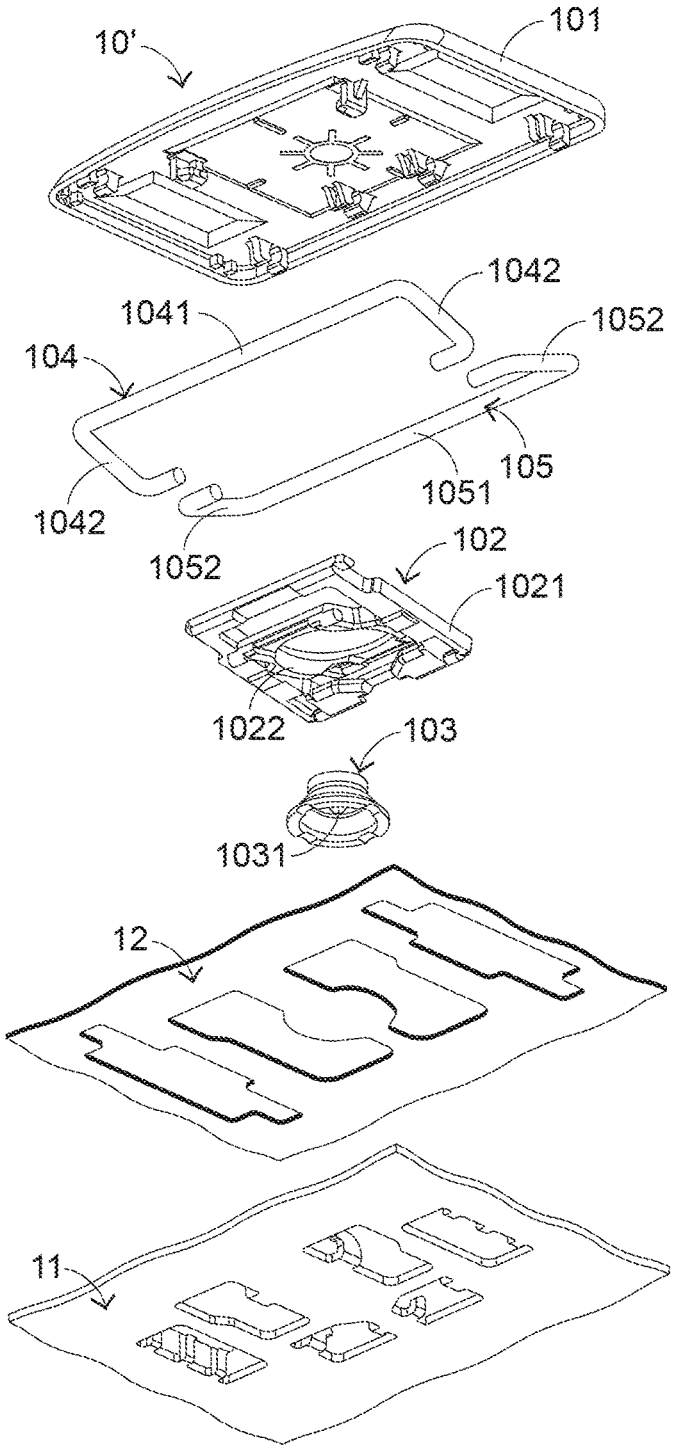
FIG.3 PRIOR ART
FIG. 3 is a schematic exploded view illustrating a portion of the keyboard device of FIG. 1 and taken along another viewpoint.
Figure 4:
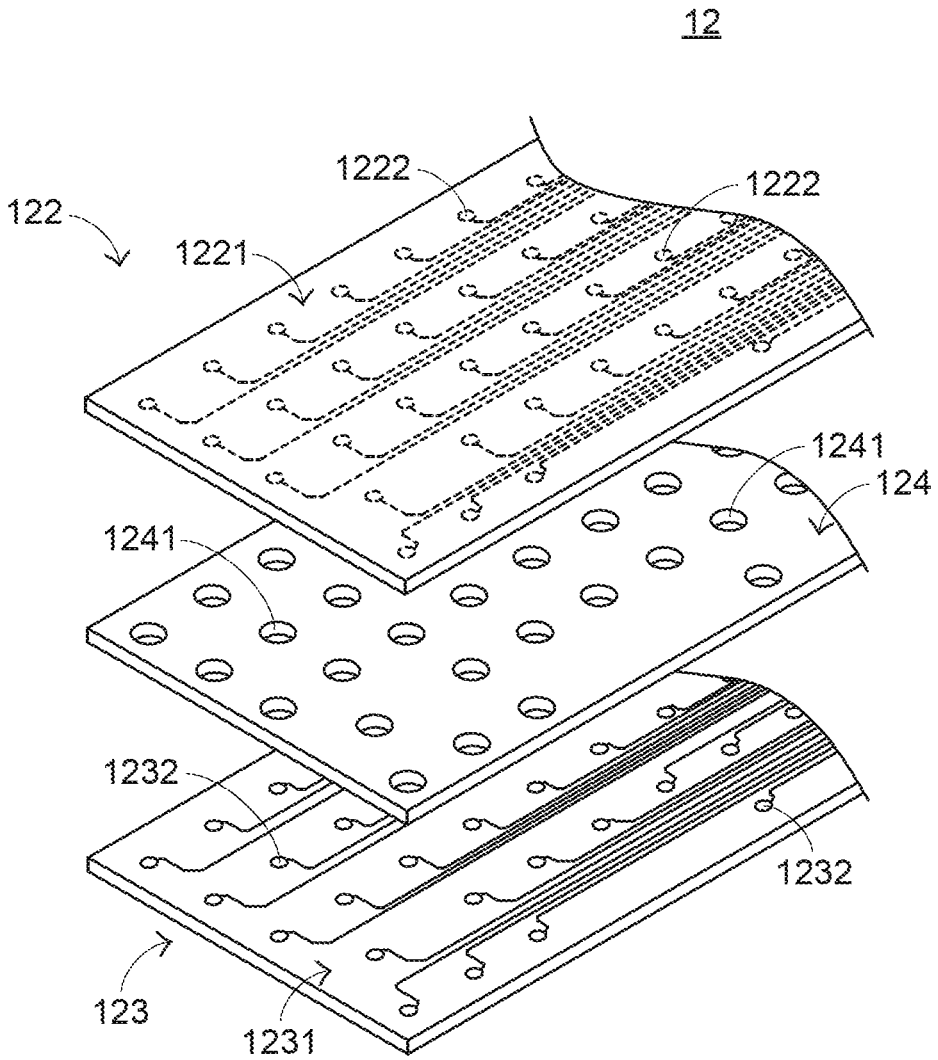
FIG.4 PRIOR ART
FIG. 4 is a schematic exploded view illustrating the membrane circuit board of the keyboard device as shown in FIG. 1.
Figure 5:
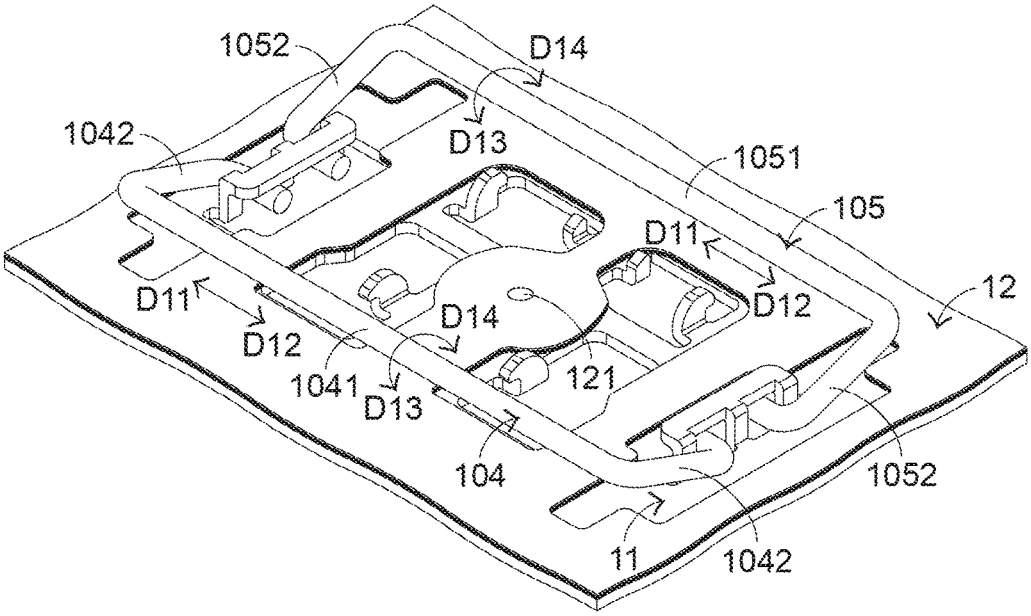
FIG.5 PRIOR ART
FIG. 5 schematically illustrates the actions of the first stabilizer bar and the second stabilizer bar of the keyboard device as shown in FIG. 1.
Figure 6:
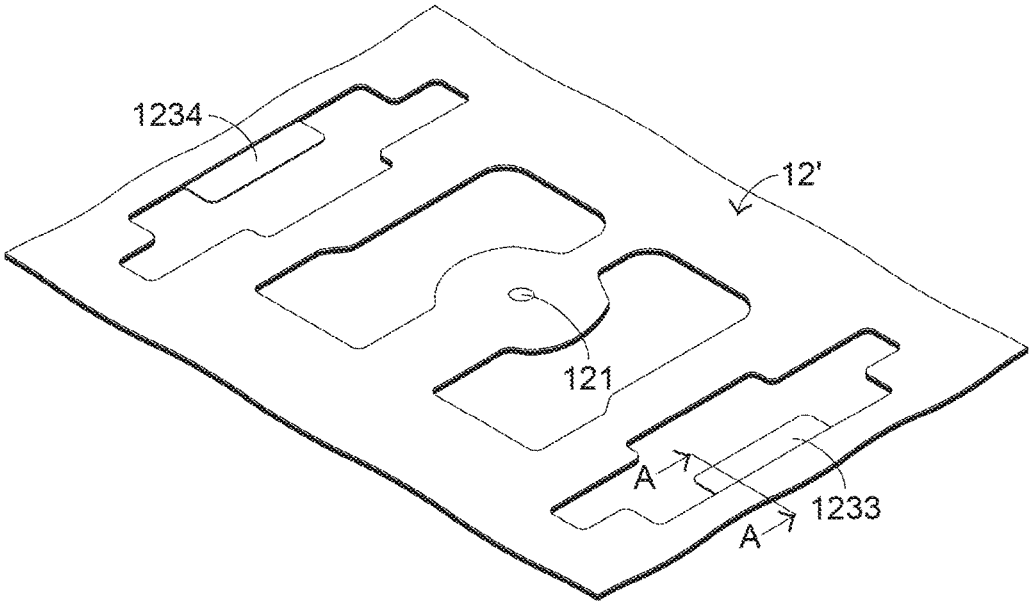
FIG.6 PRIOR ART
FIG. 6 is a schematic perspective view illustrating a membrane circuit board of another conventional keyboard.
Figure 7:
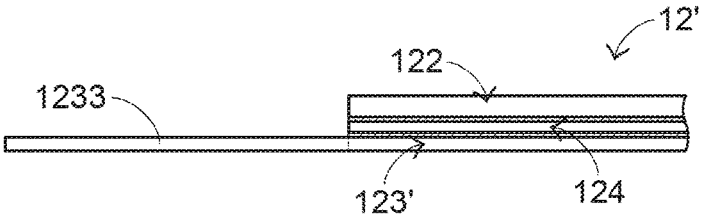
FIG.7 PRIOR ART
FIG. 7 is a schematic cross-sectional view illustrating the membrane circuit board of FIG. 6 and taken along the line A-A.
Figure 8:
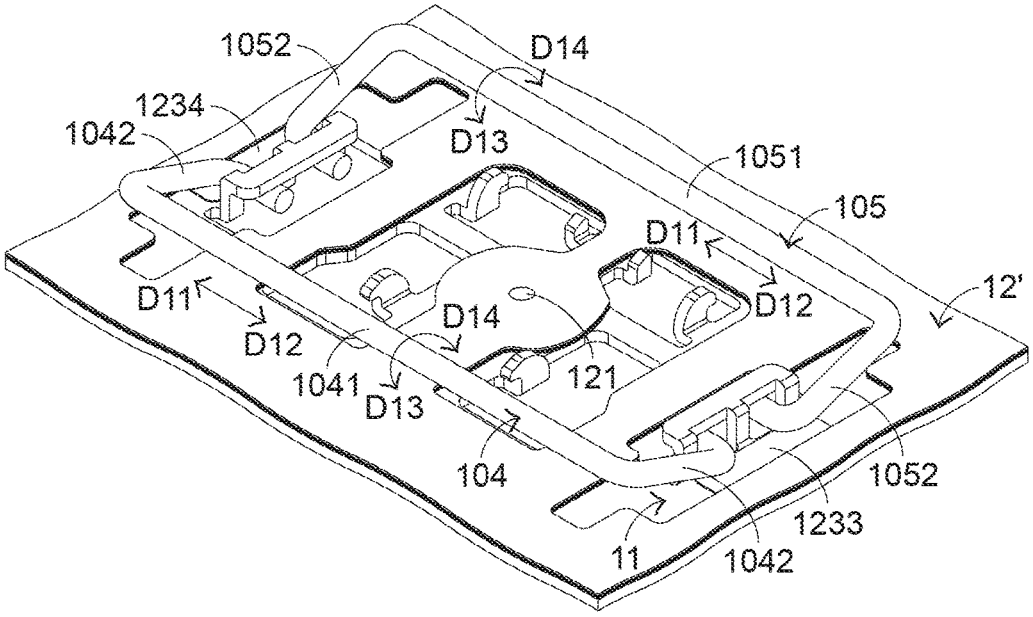
FIG.8 PRIOR ART
FIG. 8 schematically illustrates the actions of the first stabilizer bar and the second stabilizer bar of another conventional keyboard device.
Figure 9:
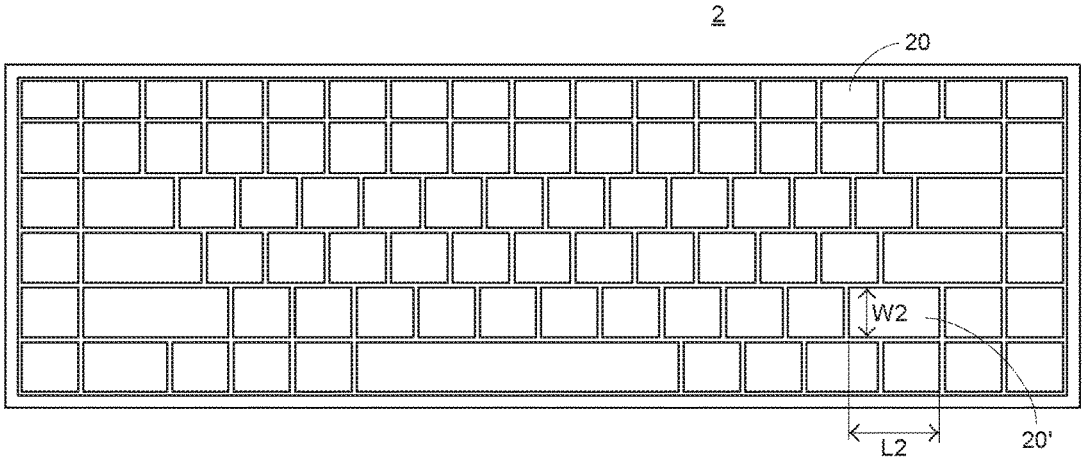
FIG. 9 is a schematic top view illustrating the outer appearance of a keyboard device according to an embodiment of the present invention.
Figure 10:
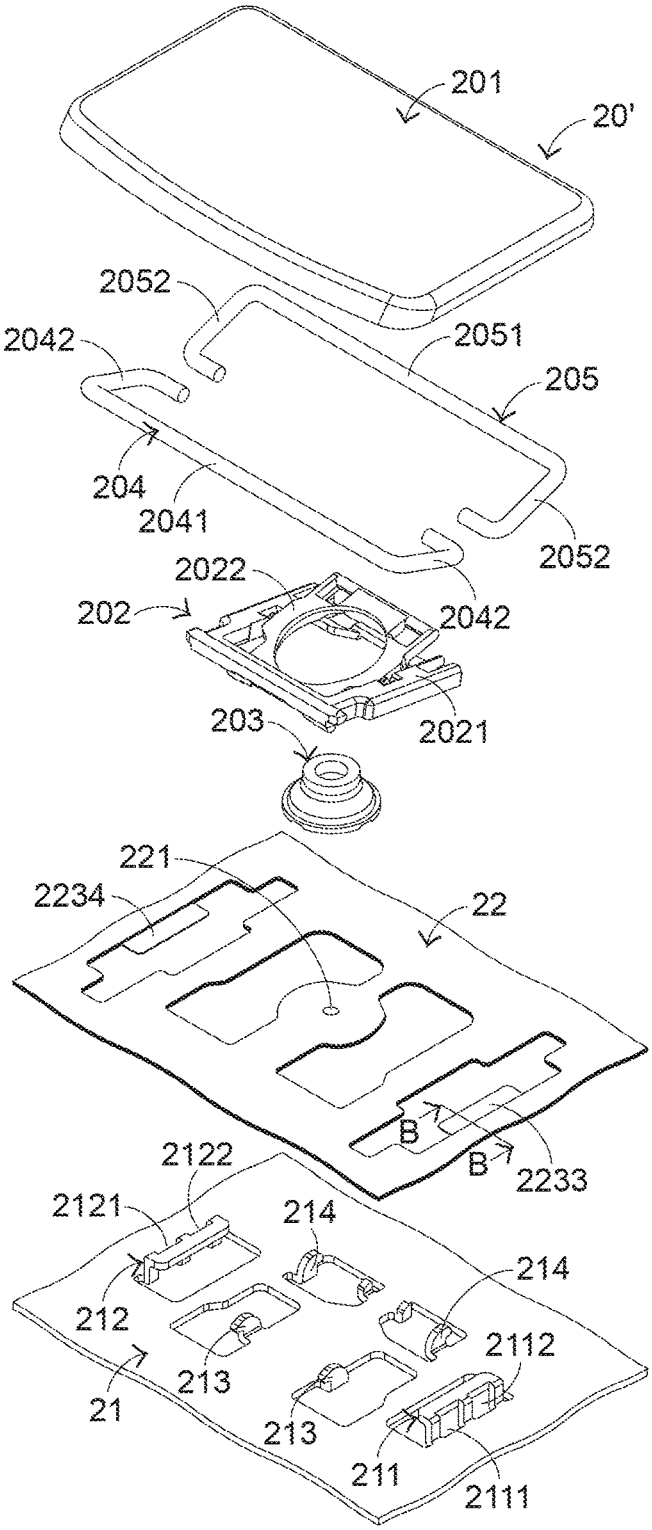
FIG. 10 is a schematic exploded view illustrating a portion of the keyboard device of FIG. 9 and taken along a viewpoint.
Figure 11:
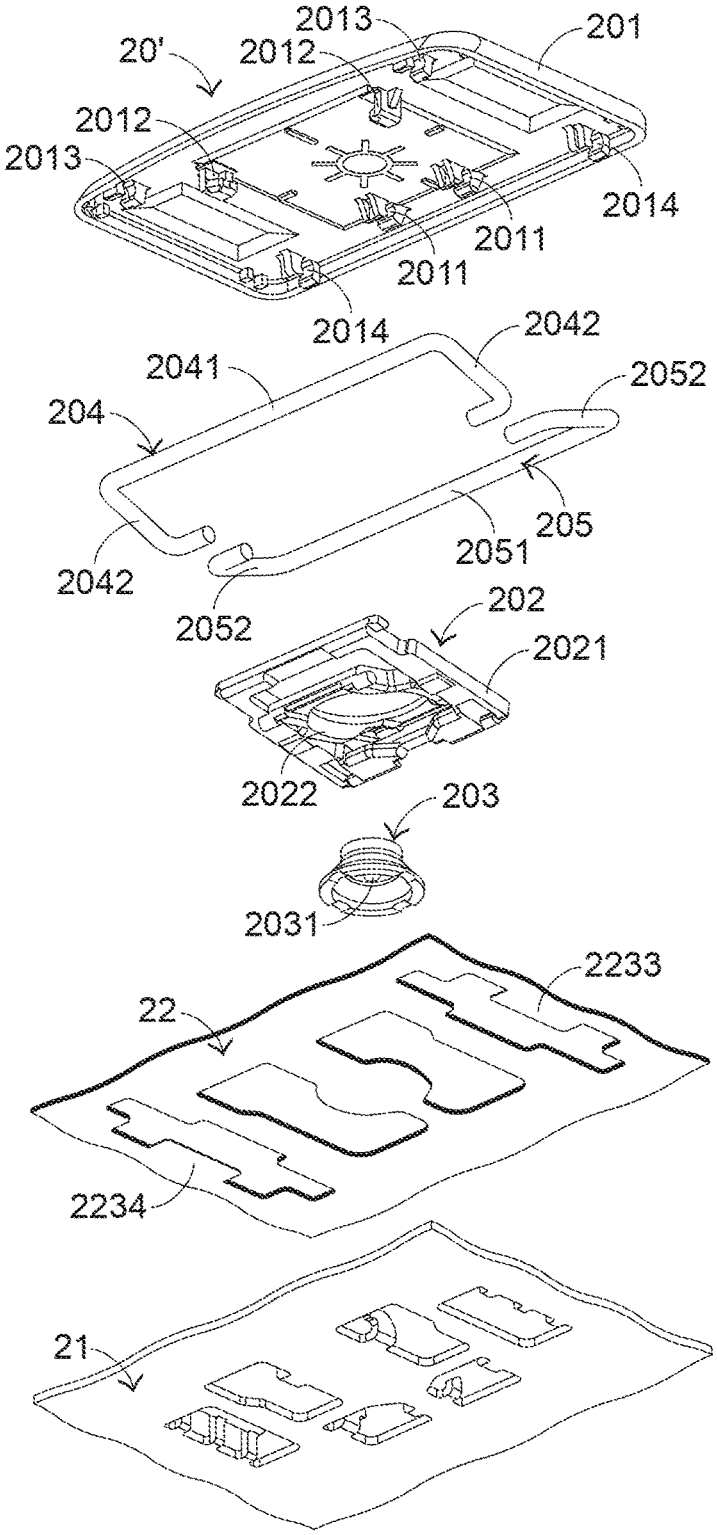
FIG. 11 is a schematic exploded view illustrating a portion of the keyboard device of FIG. 9 and taken along another viewpoint.

Please refer to FIGS. 9, 10 and 11. FIG. 9 is a schematic top view illustrating the outer appearance of a keyboard device according to an embodiment of the present invention. FIG. 10 is a schematic exploded view illustrating a portion of the keyboard device of FIG. 9 and taken along a viewpoint. FIG. 11 is a schematic exploded view illustrating a portion of the keyboard device of FIG. 9 and taken along another viewpoint. For succinctness, only one key 20' and related components are shown in FIGS. 10 and 11. The keyboard device 2 comprises plural keys 20 and 20', a base plate 21 and a membrane circuit board 22. The membrane circuit board 22 is arranged between the plural keys 20, 20' and the base plate 21. These keys 20 and 20' are classified into some types, e.g., ordinary keys, numeric keys and function keys. When one of the keys 20 and 20' is depressed by the user's finger, a corresponding key signal is generated to the computer, and thus the computer executes a function corresponding to the depressed key. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Figure 12:
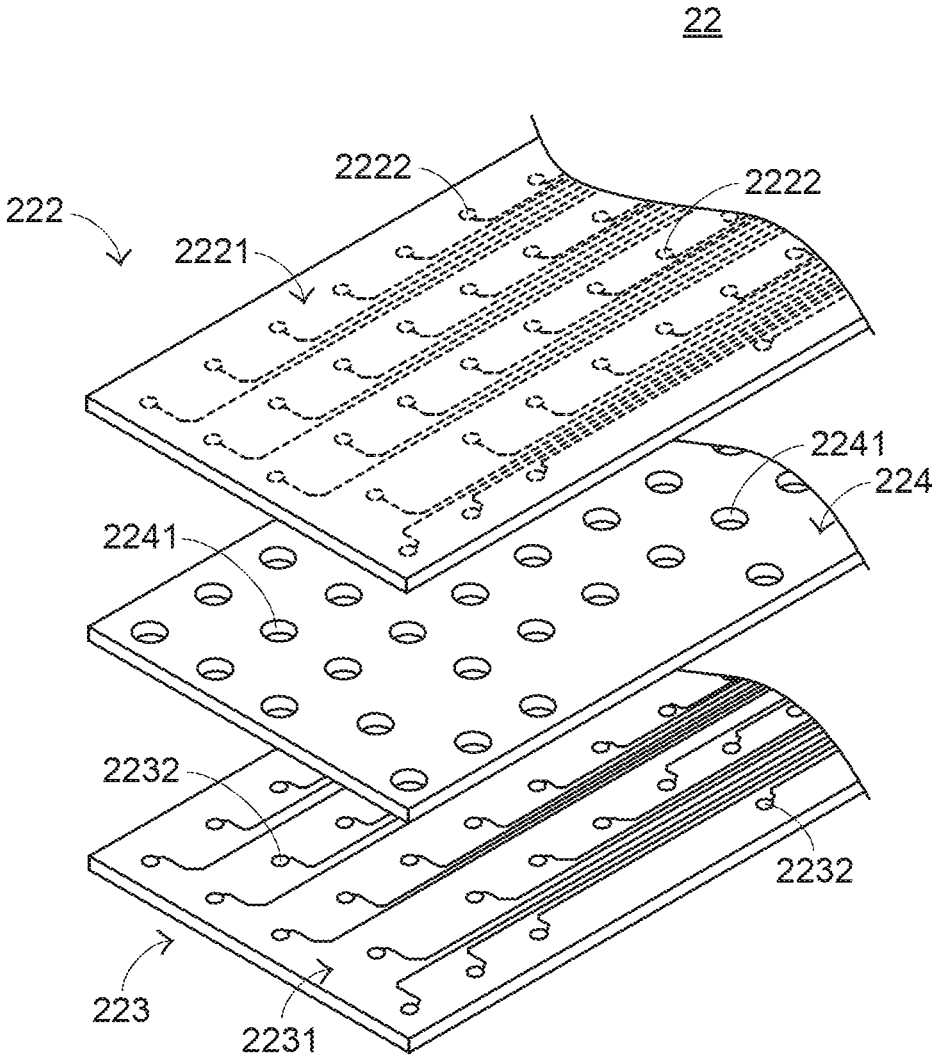
FIG. 12 is a schematic exploded view illustrating a portion of the membrane circuit board of the keyboard device as shown in FIG. 9.
Figure 13:
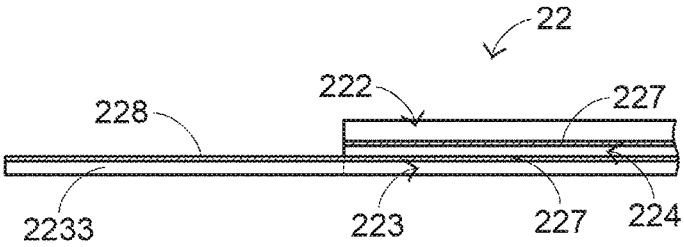
FIG. 13 is a schematic cross-sectional view illustrating the membrane circuit board of FIG. 9 and taken along the line B-B.

FIG. 12 is a schematic exploded view illustrating a portion of the membrane circuit board of the keyboard device as shown in FIG. 9. FIG. 13 is a schematic cross-sectional view illustrating the membrane circuit board of FIG. 9 and taken along the line B-B. As shown in FIGS. 12 and 13, the membrane circuit board 22 comprises a first film layer, a third film layer and a second film layer. In an embodiment, the first film layer is an upper film layer 222, the third film layer is an intermediate film layer 224, and the second film layer is a lower film layer 223. The intermediate film layer 224 is arranged between the upper film layer 222 and the lower film layer 223. The upper film layer 222 and the intermediate film layer 224 are laminated together through a first gel layer 227. The intermediate film layer 224 and the lower film layer 223 are also laminated together through the first gel layer 227. Preferably but not exclusively, the first gel layer 227 is made of UV gel, water gel or silica gel.

A first circuit pattern 2221 is formed on a bottom surface of the upper film layer 222. The first circuit pattern 2221 comprises plural upper contacts 2222 corresponding to the plural keys 20 and 20'. A second circuit pattern 2231 is formed on a top surface of the lower film layer 223. The second circuit pattern 2231 comprises plural lower contacts 2232 corresponding to the plural upper contacts 2222. Each of the upper contacts 2222 and the corresponding lower contact 2232 are separated from each other by a spacing interval. Moreover, each of the upper contacts 2222 and the corresponding lower contact 2232 are collectively defined as a membrane switch 221. The intermediate film layer 224 is arranged between the upper film layer 222 and the lower film layer 223 for maintaining the spacing interval between each upper contact 2222 and the corresponding lower contact 2232. In addition, the intermediate film layer 224 comprises plural perforations 2241 corresponding to the plural upper contacts 2222 and the plural lower contacts 2232. Preferably but not exclusively, at least one of the upper film layer 222, the lower film layer 223 and the intermediate film layer 224 is made of polycarbonate (PC), polyethylene terephthalate (PET), polymethylmethacrylate (PMMA), polyurethane (PU) or polyimide (PI).

Each of the plural keys 20 and 20' comprises a keycap 201, a connecting element 202 and an elastic element 203. The connecting element 202 is connected between the keycap 201 and the base plate 21. Through the connecting element 202, the keycap 201 is moved upwardly or downwardly relative to the base plate 21. The elastic element 203 is arranged between the keycap 201 and the base plate 21. Moreover, the elastic element 203 comprises a contacting part 2031. In this embodiment, the connecting element 202 is a scissors-type connecting element. Moreover, the connecting element 202 comprises a first frame 2021 and a second frame 2022. The second frame 2022 is pivotally coupled to the first frame 2021. Consequently, the first frame 2021 and the second frame 2022 can be swung relative to each other.

Each keycap 201 comprises a connecting lock part 2011 and a connecting hook part 2012. The base plate 21 comprises a first hook 213 and a second hook 214. The first hook 213 and the second hook 214 are protruded upwardly and penetrated through the membrane circuit board 22. A first end of the first frame 2021 is connected with the connecting lock part 2011 of the keycap 201. A second end of the first frame 2021 is connected with the second hook 214 of the base plate 21. A first end of the second frame 2022 is connected with the connecting hook part 2012 of the keycap 201. A second end of the second frame 2022 is connected with the first hook 213 of the base plate 21. The connecting relationships between the connecting element 202, the base plate 21 and the keycap 201 are presented herein for purpose of illustration and description only.

While the keycap 201 of any key 20 or 20' is depressed and moved downwardly relative to the base plate 21, the first frame 2021 and the second frame 2022 of the connecting element 202 are switched from an open-scissors state to a stacked state. Moreover, as the keycap 201 is moved downwardly to compress the elastic element 203, the corresponding upper contact 2222 is pushed and triggered by the contacting part 2031 of the elastic element 203. Consequently, the corresponding upper contact 2222 is contacted with the corresponding lower contact 2232 through the corresponding perforation 2241. In such way, the corresponding membrane switch 221 is electrically conducted, and the keyboard device 2 generates a corresponding key signal. When the keycap 201 of the key 20 or 20' is no longer depressed, the keycap 201 is moved upwardly relative to the base plate 21 in response to an elastic force of the elastic element 203. Meanwhile, the first frame 2021 and the second frame 2022 are switched from the stacked state to the open-scissors state again, and the keycap 201 is returned to its original position.

As shown in FIGS. 9, 10 and 11, the length L2 of the key 20' is larger than the width W2 of the key 20'. The key 20' further comprises a first stabilizer bar 204 and a second stabilizer bar 205. The first stabilizer bar 204 comprises a first transverse bar part 2041 and two first hook parts 2042. The two first hook parts 2042 are located at two ends of the first stabilizer bar 204, respectively. The second stabilizer bar 205 comprises a second transverse bar part 2051 and two second hook parts 2052. The two second hook parts 2052 are located at two ends of the second stabilizer bar 205, respectively.

As mentioned above, the length L2 of the key 20' is larger than the width W2 of the key 20'. The keycap 201 of the key 20' further comprises plural first stabilizer lock parts 2013 and plural second stabilizer lock parts 2014. The first transverse bar part 2041 is penetrated through the plural first stabilizer lock parts 2013 and pivotally coupled to the plural first stabilizer lock parts 2013. The second transverse bar part 2051 is penetrated through the plural second stabilizer lock parts 2014 and pivotally coupled with the plural second stabilizer lock parts 2014.

The base plate 21 comprises a first connecting structure 211 and a second connecting structure 212. The first connecting structure 211 and the second connecting structure 212 are protruded upwardly, and penetrated through the membrane circuit board 22. The first connecting structure 211 comprises a first locking hole 2111 and a third locking hole 2112. The second connecting structure 212 comprises a second locking hole 2121 and a fourth locking hole 2122. The second locking hole 2121 corresponds to the first locking hole 2111, and the fourth locking hole 2122 corresponds to the third locking hole 2112. The two first hook parts 2042 of the first stabilizer bar 204 are penetrated through the first locking hole 2111 of the first connecting structure 211 and the second locking hole 2121 of the second connecting structure 212, respectively. The two second hook parts 2052 of the second stabilizer bar 205 are penetrated through the third locking hole 2112 of the first connecting structure 211 and the fourth locking hole 2122 of the second connecting structure 212, respectively.

Figure 14:
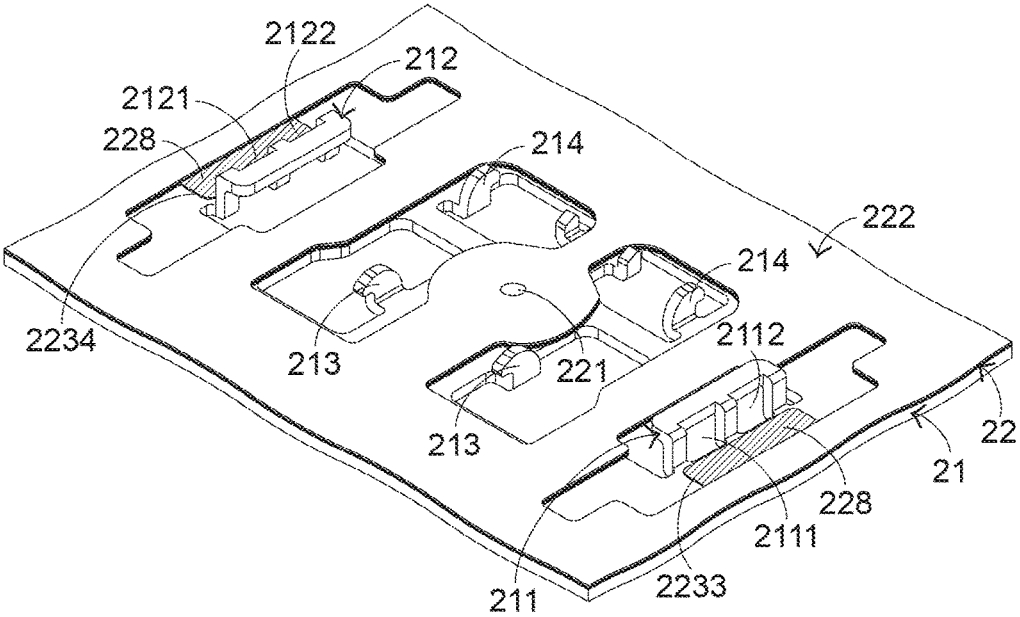
FIG. 14 is a schematic perspective view illustrating a portion of the combination of the base plate and the membrane circuit board of the keyboard device as shown in FIG. 10.
Figure 15:
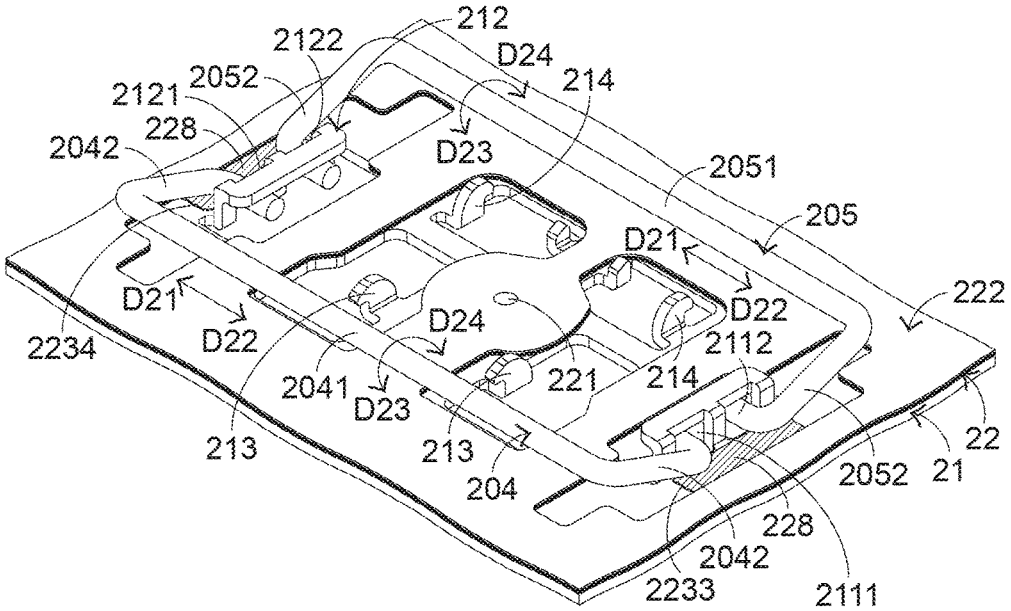
FIG. 15 schematically illustrates the actions of the first stabilizer bar and the second stabilizer bar of the keyboard device as shown in FIG. 10.

FIG. 14 is a schematic perspective view illustrating a portion of the combination of the base plate and the membrane circuit board of the keyboard device as shown in FIG. 10. FIG. 15 schematically illustrates the actions of the first stabilizer bar and the second stabilizer bar of the keyboard device as shown in FIG. 10. Please refer to FIGS. 12, 13, 14 and 15. While the keycap 201 of the key 20' is moved upwardly or downwardly relative to the base plate 21, the first stabilizer bar 204 is moved in the direction D21 or the direction D22 and rotated in the direction D23 or the direction D24, and the first transverse bar part 2041 of the first stabilizer bar 204 is rotated relative to the plural first stabilizer lock parts 2013. Similarly, the second stabilizer bar 205 is moved in the direction D21 or the direction D22 and rotated in the direction D23 or the direction D24, and the second transverse bar part 2051 of the second stabilizer bar 205 is rotated relative to the plural second stabilizer lock parts 2014. By this design, the key 20' is kept stable and not inclined while the key 20' is moved upwardly or downwardly relative to the base plate 21. Moreover, this design is helpful to increase the strength of the keycap 201.

The membrane circuit board 22 of the keyboard device 2 further comprises a first extension part 2233 and a second extension part 2234. The first extension part 2233 and the second extension part 2234 are extended from the lower film layer 223. Moreover, the first extension part 2233 is extended in a direction toward the first connecting structure 211 and exposed to the outside through the upper film layer 222 and the intermediate film layer 224. The second extension part 2234 is extended in a direction toward the second connecting structure 212 and exposed to the outside through the upper film layer 222 and the intermediate film layer 224. The two first hook parts 2042 of the first stabilizer bar 204 are separated from the base plate 21 by the first extension part 225. The two second hook parts 2052 of the second stabilizer bar 205 are separated from the base plate 21 by the second extension part 226. While the keycap 201 of the key 20' is moved upwardly or downwardly relative to the base plate 21 and the first stabilizer bar 204 and the second stabilizer bar 205 are correspondingly moved and rotated, the two first hook parts 2042 of the first stabilizer bar 204 and the two second hook parts 2052 of the second stabilizer bar 205 are not directly contacted with the base plate 21. Since the two first hook parts 2042 and the two second hook parts 2052 do not collide with the base plate 21, the unpleasant noise is not generated.

Especially, a second gel layer 228 is formed on the first extension part 2233 and the second extension part 2234 of the keyboard device 2. While the keycap 201 of the key 20' is moved upwardly or downwardly relative to the base plate 21 and the first stabilizer bar 204 and the second stabilizer bar 205 are correspondingly moved and rotated, the two first hook parts 2042 of the first stabilizer bar 204 and the two second hook parts 2052 of the second stabilizer bar 205 are moved on the second gel layer 228, which is formed on the first extension part 2233 and the second extension part 2234. The second gel layer 228 is a cured gel layer, which will be described later. Due to the thickness of the second gel layer 228, the noise reducing efficacy of the keyboard device 2 is enhanced.

In an embodiment, the second gel layer 228 is identical to the first gel layer 227. Consequently, the second gel layer 228 and the first gel layer 227 are formed by the same fabricating process (e.g., a printing process or a coating process) during the process of fabricating the membrane circuit board 22. Moreover, after the first gel layer 227 is formed on the lower film layer 223, the intermediate film layer 224 is placed over the lower film layer 223 and initially combined with the lower film layer 223 through the first gel layer 227. Then, the upper film layer 222 and the intermediate film layer 224 are initially combined together through the first gel layer 227. After the upper film layer 222 and the intermediate film layer 224 are initially combined together and the intermediate film layer 224 and the lower film layer 223 are initially combined together, the membrane circuit board 22 is subjected to a cured process (e.g., a thermally treating process). Consequently, the upper film layer 222 and the intermediate film layer 224 are securely combined together and the intermediate film layer 224, and the lower film layer 223 are secured combined together. Moreover, after the cured process is performed on the membrane circuit board 22, the exposed second gel layer 228 is cured and thus the stickiness of the second gel layer 228 loses. Consequently, the two first hook parts 2042 of the first stabilizer bar 204 and the two second hook parts 2052 of the second stabilizer bar 205 are movable on the second gel layer 228.

From the above descriptions, the keyboard device 2 of the present invention has many benefits. For example, during the process of fabricating the membrane circuit board 22, the gel layer coated or printed on the lower film layer 223 can increase the thicknesses of the first extension part 2233 and the second extension part 2234. That is, it is not necessary to perform the post-processing process. Even if the thickness of the keyboard device is reduced, the keyboard device of the present invention also has the satisfied noise reducing efficacy. In other words, the keyboard device of the present invention is industrially valuable.

It is noted that numerous modifications and alterations may be made while retaining the teachings of the invention. For example, in another embodiment, the lower film layer does not contain the first extension part and the second extension part. In this case, the first extension part and the second extension part are extended from the intermediate film layer, and respectively extended in the directions toward the first connecting structure and the second connecting structure, and exposed to the outside through the upper film layer and the lower film layer. Due to the gel layer, the thicknesses of the first extension part and the second extension part are increased. In another embodiment, both of the lower film layer and the intermediate film layer does not contain the first extension part and the second extension part. In this case, the first extension part and the second extension part are extended from the upper film layer film layer, and respectively extended in the directions toward the first connecting structure and the second connecting structure, and exposed to the outside through the lower film layer and the intermediate. Due to the gel layer, the thicknesses of the first extension part and the second extension part are increased.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A keyboard device, comprising:

a key comprising a keycap and a stabilizer bar, wherein the stabilizer bar comprises a transverse bar part and a first hook part, wherein the transverse bar part is pivotally coupled to the keycap, and the first hook part is located at a first end of the transverse bar part;

a base plate connected with the key, and comprising a first connecting structure, wherein the first connecting structure is protruded upwardly from the base plate and connected with the first hook part of the stabilizer bar; and a membrane circuit board arranged between the key and the base plate, and comprising a membrane switch corresponding to the key, wherein the membrane circuit board comprises a first film layer and a second film layer, and the first film layer and the second film layer are laminated together through a first gel layer, wherein the second film layer comprises a first extension part, and the first extension part is extended toward the first connecting structure and exposed outside the first film layer, wherein a second gel layer is formed on the first extension part, and the first hook part of the stabilizer bar is moved on the second gel layer while the keycap is moved upwardly or downwardly relative to the base plate.

2. The keyboard device according to claim 1, wherein the first film layer is one film layer of an upper film layer, an intermediate film layer and a lower film layer, and the second film is another film layer of the upper film layer, the intermediate film layer and the lower film layer that is located beside the first film layer, wherein a first circuit pattern is formed on the upper film layer, a second circuit pattern is formed on the lower film layer, the first circuit pattern comprises an upper contact, and the second circuit pattern comprises a lower contact, wherein the upper contact and the lower contact are separated from each other by a spacing interval and collectively defined as the membrane switch.

3. The keyboard device according to claim 1, wherein at least one of the first film layer and the second film layer is made of polycarbonate (PC), polyethylene terephthalate (PET), polymethylmethacrylate (PMMA), polyurethane (PU) or polyimide (PI).

4. The keyboard device according to claim 1, wherein the keycap further comprises a stabilizer lock part, and the transverse bar part of the stabilizer bar is penetrated through the stabilizer lock part and pivotally coupled to the stabilizer lock part, wherein while the keycap is moved upwardly or downwardly relative to the base plate, the transverse bar part is rotated relative to the stabilizer lock part.

5. The keyboard device according to claim 1, wherein the key further comprises an elastic element, and the elastic element is arranged between the keycap and the membrane circuit board and comprises a contacting part, wherein while the keycap is depressed, the elastic element is compressed and the membrane switch is pushed by the contacting part, wherein when the keycap is not depressed, the keycap is returned to an original position in response to an elastic force provided by the elastic element.

6. The keyboard device according to claim 1, wherein the first connecting structure comprises a first locking hole, and the first hook part of the stabilizer bar is penetrated through the first locking hole.

7. The keyboard device according to claim 6, wherein the base plate further comprises a second connecting structure, and the second connecting structure is protruded upwardly from the base plate and comprises a second locking hole, wherein the stabilizer bar further comprises a second hook part, and the second hook part is located at a second end of the transverse bar part and penetrated through the second locking hole, wherein the second film layer further comprises a second extension part, and the second extension part is extended toward the second connecting structure and exposed outside the first film layer, wherein the second gel layer is further formed on the second extension part, and the second hook part of the stabilizer bar is moved on the second gel layer while the keycap is moved upwardly or downwardly relative to the base plate.

8. The keyboard device according to claim 1, wherein the key further comprises a connecting element, and the connecting element is connected between the base plate and the keycap, wherein the keycap is movable upwardly or downwardly relative to the base plate through the connecting element.

9. The keyboard device according to claim 8, wherein the connecting element is a scissors-type connecting element comprising a first frame and a second frame, and the second frame is pivotally coupled to the first frame.

10. The keyboard device according to claim 9, wherein the keycap comprises a connecting lock part and a connecting hook part, wherein the connecting lock part is connected with an end of the first frame, and the connecting hook part is connected with an end of the second frame.

11. The keyboard device according to claim 9, wherein the base plate further comprises a first hook and a second hook, and the first hook and the second hook are protruded upwardly, wherein the first hook is connected with an end of the second frame, and the second hook is connected with an end of the first frame.

* * * * *